US011815039B1

(12) United States Patent
Chen

(10) Patent No.: US 11,815,039 B1
(45) Date of Patent: Nov. 14, 2023

(54) ROTARY OIL-ELECTRICITY HYBRID ENGINE

(71) Applicant: Rui Chen, Zhongshan (CN)

(72) Inventor: Rui Chen, Zhongshan (CN)

( * ) Notice: Subject to any disclaimer, the term of this patent is extended or adjusted under 35 U.S.C. 154(b) by 0 days.

(21) Appl. No.: 18/354,754

(22) Filed: Jul. 19, 2023

(30) Foreign Application Priority Data

Jul. 21, 2022 (CN) ..... 202210855444.8

(51) Int. Cl.
*F02D 31/00* (2006.01)
*F02B 53/14* (2006.01)

(52) U.S. Cl.
CPC ..... *F02D 31/001* (2013.01); *F02B 53/14* (2013.01); *F02B 2710/02* (2013.01); *F02D 2200/101* (2013.01); *F02D 2400/02* (2013.01)

(58) Field of Classification Search
CPC ..... F02D 31/001; F02D 53/41
See application file for complete search history.

(56) References Cited

FOREIGN PATENT DOCUMENTS

| | | | |
|---|---|---|---|
| CN | 1197159 | A | 10/1998 |
| CN | 103195561 | A | 7/2013 |
| CN | 106337731 | A | 1/2017 |
| WO | 2009039681 | A1 | 4/2009 |

*Primary Examiner* — Sean Gugger

(57) ABSTRACT

A rotary oil-electricity hybrid engine is an engine with a brand new structure, taking an inner rotor connected with a power output shaft as an example, the rotary oil-electricity hybrid engine is structurally characterized in that: an annular cavity is formed by an outer rotor cylinder and an inner rotor shaft core, an outer rotor blade and an inner rotor blade divide the annular cavity into a combustion chamber and a buffer chamber, and an outer rotor and an inner rotor rotate in the same direction with a changing angle difference within a round angle; and the rotary oil-electricity hybrid engine is operationally characterized in that: gas in the combustion chamber is emptied during cold start, and a numerical control motor is linked with a bump of a limiting ring to enable the inner and outer rotors to mesh, rotate at a constant speed and reach a high rotating speed.

9 Claims, 12 Drawing Sheets

ROTARY OIL-ELECTRICITY HYBRID ENGINE

CROSS REFERENCE TO RELATED APPLICATIONS

This application claims foreign priority of Chinese Patent Application No. 202210855444.8, filed on Jul. 21, 2022 in the China National Intellectual Property Administration, the disclosures of all of which are hereby incorporated by reference.

TECHNICAL FIELD

The present invention relates to the technical field of engines, and more particularly to a rotary oil-electricity hybrid engine.

BACKGROUND OF THE PRESENT INVENTION

Traditional fuel oil engines refer to a gasoline engine or a diesel engine, both of which are a reciprocating piston engine composed of a crankshaft connecting rod mechanism, and this engine structure needs to waste a lot of mechanical energy to overcome the inertia of pistons and crankshaft connecting rods, resulting in low thermal efficiency conversion, with the shortcomings of large vibration and noise caused by imbalance, large volume, unchangeable gas compression ratio, and the like, and the incapability of frequency conversion working according to actual needs.

Wankel triangle rotor engine has the problems of high oil consumption, high emission, poor sealing and easy damage due to the structural defects of long and narrow combustion chamber and low gas compression ratio.

In the past twenty years, many people have put forward the solutions of scissor and rotary engines, but the solutions have not been realized so far. It is concluded that the common defect is that powers of four links of suction, compression, deflagration and exhaust all come from a link of deflagration, and then the automatic operation of four strokes is driven by various mechanical linkages, which cannot adapt to a power change, so that the solutions cannot be realized.

SUMMARY OF PRESENT INVENTION

The present invention aims to solve the defects in the above background, and provides a rotary oil-electricity hybrid engine, which uses a control circuit to control three links of suction, compression and exhaust of the engine through a motor, cancels structures such as a reciprocating piston and a crankshaft connecting rod, cancels a fixed gas cylinder in a frame, simplifies a structure of the gas cylinder, and is a brand new engine with low vibration, low noise, low oil consumption, low emission, high conversion rate, variable frequency and variable fuel.

In order to achieve the above object, the present invention provides the following technical solution: a rotary oil-electricity hybrid engine comprises an inner rotor, an outer rotor, a numerical control motor, a storage battery, a microcomputer controller, a rotating speed sensor and a power output shaft, wherein, the inner rotor comprises an inner rotor shaft core and an inner rotor blade, the outer rotor comprises an outer rotor cylinder and an outer rotor blade, the inner rotor shaft core is freely and rotatably connected to the outer rotor cylinder coaxially to form an annular cavity, the inner rotor blade and the outer rotor blade divide the cavity into a combustion chamber and a buffer chamber, and the outer rotor cylinder corresponding to the combustion chamber is provided with a gas inlet port, an exhaust port, and an ignition port or fuel injection port penetrating through the cylinder; and the inner rotor or the outer rotor is connected to the power output shaft, the other rotor is directly or indirectly connected to a rotating shaft of the numerical control motor, the inner rotor and the outer rotor rotate in the same direction with a rotating angle difference within a round angle during working of the engine, the rotating speed sensor records rotating speeds of the inner rotor and the outer rotor and feeds the rotating speeds back to the microcomputer controller, the microcomputer controller sends a speed regulation instruction to the numerical control motor to control the rotating angle difference between the inner rotor and the outer rotor, and controls switching on and off of control valves of the combustion chamber gas inlet port, the combustion chamber exhaust port, and the combustion chamber ignition port or fuel injection port to realize circulation of four strokes of suction, compression, expansion work and exhaust, and the storage battery provides a power supply for the microcomputer controller and the numerical control motor.

Preferably, the numerical control motor is connected to an inertia flywheel first, and then connected to the outer rotor from the inertia flywheel through a power input shaft.

Preferably, the outer rotor cylinder corresponding to the buffer chamber is provided with a buffer chamber gas inlet port and a buffer chamber exhaust port which penetrate through the cylinder, and the buffer chamber gas inlet port and the buffer chamber exhaust port are connected to a filtering and cooling box through pipelines to form internal circulation.

Preferably, grooves are arranged at corresponding positions of the combustion chamber gas inlet port, the combustion chamber exhaust port, the combustion chamber ignition port or fuel injection port, a buffer chamber gas inlet port and a buffer chamber exhaust port on the outer rotor cylinder respectively, and a combustion chamber gas inlet ring sleeve, a combustion chamber exhaust ring sleeve, a combustion chamber ignition or fuel injection ring sleeve, a buffer chamber gas inlet ring sleeve and a buffer chamber exhaust ring sleeve are freely and rotatably mounted at corresponding positions on the grooves respectively.

Preferably, a combustion chamber gas inlet ring sleeve, a combustion chamber exhaust ring sleeve, a combustion chamber ignition or fuel injection ring sleeve, a buffer chamber gas inlet ring sleeve and a buffer chamber exhaust ring sleeve are fixedly connected with a combustion chamber gas inlet control valve, a combustion chamber exhaust control valve, a combustion chamber ignition or fuel injection control valve, a buffer chamber gas inlet control valve and a buffer chamber exhaust control valve respectively, and switching on and off of the control valves are controlled by an instruction of the microcomputer controller.

Preferably, a center shaft of the outer rotor is provided with an outer rotor shaft core with the same outer diameter as the inner rotor shaft core, two wear-resistant sealing ring pads are arranged between the inner rotor shaft core and the outer rotor shaft core, and a sum of a length of the inner rotor shaft core, a length of the outer rotor shaft core and thicknesses of the two wear-resistant sealing ring pads is equal to an in-cylinder depth of the outer rotor cylinder.

Preferably, a through-hole pipeline is arranged in the middle of an outer rotor shaft core, a shaft core pull rod of the inner rotor shaft core penetrates through two wear-resistant sealing ring pads first and then penetrates through the through-hole pipeline, and a slip ring sheet locks a tail end of the shaft core pull rod to tighten the outer rotor and the inner rotor.

Preferably, the outer rotor cylinder is freely and rotatably fixed on an engine frame through a frame outer rotor bearing.

Preferably, a limiting ring is fixedly mounted at an outer intersection of the outer rotor and the inner rotor, a side of the limiting ring close to an inner rotor cover is provided with a limiting bump, a part of the inner rotor cover of the inner rotor close to the limiting ring is also provided with a limiting bump, and outer peripheral surfaces of the limiting ring and the adjacent inner rotor cover are provided with sensor scale marks.

Compared with the prior art, the rotary oil-electricity hybrid engine of the present invention is an engine with a brand new structure, taking the inner rotor connected with the power output shaft as an example, the rotary oil-electricity hybrid engine is structurally characterized in that: the annular cavity is formed by the outer rotor cylinder and the inner rotor shaft core, the outer rotor blade and the inner rotor blade divide the annular cavity into the combustion chamber and the buffer chamber, and the outer rotor and the inner rotor rotate in the same direction with the changing angle difference within the round angle; and the rotary oil-electricity hybrid engine is operationally characterized in that: gas in the combustion chamber is emptied during cold start, and the numerical control motor is linked with a bump of the limiting ring to enable the inner and outer rotors to mesh, rotate at a constant speed and reach a high rotating speed; during the suction stroke, the numerical control motor is decelerated to drive the outer rotor to be decelerated, and inertia increases the angle difference between the inner and outer rotors to realize the suction stroke; the numerical control motor is accelerated for catching up to reduce the angle difference between the inner and outer rotors to realize the compression stroke; a total mass of the numerical control motor, the inertia flywheel and the outer rotor is much larger than amass of the inner rotor, and a counter-acting force rotating in the same direction is provided for the expansion work stroke; and the numerical control motor is accelerated for catching up to reduce the angle difference between the inner and outer rotors to finish the exhaust stroke to enter circulation. The beneficial effects are that: a complicated reciprocating structure of piston and crankshaft connecting rod of a reciprocating piston engine is omitted, the structural shortcomings of a Wankel triangle rotor engine such as poor gear meshing, easy wear and low compression ratio are also overcome, and the advantages of high heat conversion efficiency, low emission, stable operation, variable frequency and the like are realized.

REFERENCE NUMERALS OF THE DRAWINGS

Figure 1:
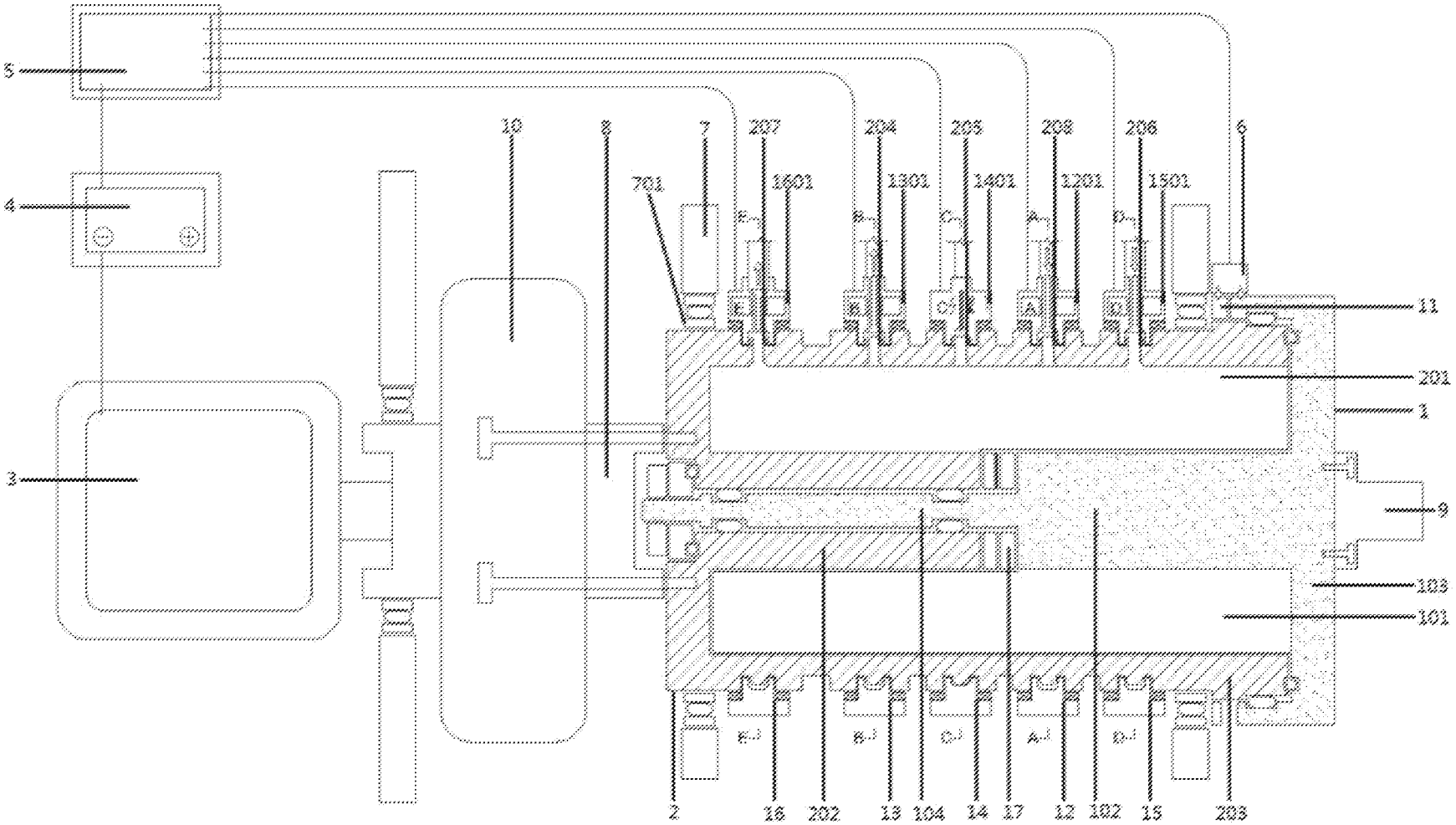
FIG. 1 is a structural diagram of an engine of the present invention.

1 refers to inner rotor, 101 refers to inner rotor blade, 102 refers to inner rotor shaft core, 103 refers to inner rotor cover, 104 refers to shaft core pull rod, 105 refers to roller, 106 refers to roll ball, 107 refers to slip ring sheet, 108 refers to nut or plug, and 109 refers to inner rotor sensor scale mark; 2 refers to outer rotor, 201 refers to outer rotor blade, 202 refers to outer rotor shaft core, 203 refers to outer rotor cylinder, 204 refers to combustion chamber exhaust port, 205 refers to combustion chamber ignition or fuel injection port, 206 refers to buffer chamber gas inlet port, 207 refers to buffer chamber exhaust port, and 208 refers to combustion chamber gas inlet port; 3 refers to numerical control motor; 4 refers to storage battery; 5 refers to microcomputer controller; 6 refers to rotating speed sensor; 7 refers to engine frame, 701 refers to frame outer rotor bearing; 8 refers to power input shaft; 9 refers to power output shaft; 10 refers to inertia flywheel; 11 refers to limiting ring, and 1101 refers to outer rotor sensor scale mark; 12 refers to combustion chamber gas inlet ring sleeve, and 1201 refers to combustion chamber gas inlet control valve; 13 refers to combustion chamber exhaust ring sleeve, and 1301 refers to combustion chamber exhaust control valve; 14 refers to combustion chamber ignition or fuel injection ring sleeve, and 1401 refers to combustion chamber ignition or fuel injection control valve; 15 refers to buffer chamber gas inlet ring sleeve, and 1501 refers to buffer chamber gas inlet control valve; 16 refers to buffer chamber exhaust ring sleeve, and 1601 refers to buffer chamber exhaust control valve; 17 refers to wear-resistant sealing ring pad, and 1701 refers to ring pad oil guide groove; 18 refers to combustion chamber; and 19 refers to buffer chamber.

DETAILED DESCRIPTION OF PREFERRED EMBODIMENTS

The technical solution in the embodiments of the present invention will be clearly and completely described hereinafter with reference to the drawings in the embodiments of the present invention. Apparently, the described embodiments are only some but not all of the embodiments of the present invention. Based on the embodiments in the present invention, all other embodiments obtained by those of ordinary skills in the art without going through any creative work should fall within the scope of protection of the present invention.

In the description of the present invention, it should be understood that the orientation or position relationship indicated by the terms "up", "down", "front", "rear", "left", "right", "vertical", "horizontal", "top", "bottom", "inside", "outside", and the like is based on the orientation or position relationship shown in the drawings, it is only for the convenience of description of the present invention and simplification of the description, and it is not to indicate or imply that the indicated device or element must have a specific orientation, and be constructed and operated in a specific orientation. Therefore, the terms should not be understood as limiting the present invention.

In the present invention, the terms "installation", "connected", "connection", "fixation", and the like should be understood in broad sense unless otherwise specified and defined. For example, they may be fixed connection, removable connection or integrated connection; may be mechanical connection or electrical connection; and may be direct connection, or indirect connection through an intermediate medium, and connection inside two components, or interaction relation of two elements. The specific meanings of the above terms in the present invention may be understood in a specific case by those of ordinary skills in the art.

As shown in FIG. 1, FIG. 2, FIG. 15 and FIG. 16, a rotary oil-electricity hybrid engine has parts, comprising an inner rotor 1, an outer rotor 2, a numerical control motor 3, a storage battery 4, a microcomputer controller 5, a rotating speed sensor 6 and a power output shaft 9, and further comprising an engine frame 7, a power input shaft 8, an inertia flywheel 10, a limiting ring 11, a combustion chamber gas inlet ring sleeve 12, a combustion chamber exhaust ring sleeve 13, a combustion chamber ignition or fuel injection ring sleeve 14, a buffer chamber gas inlet ring sleeve 15, a buffer chamber exhaust ring sleeve 16 and a wear-resistant sealing ring pad 17.

The inner rotor 1 comprises an inner rotor blade 101, an inner rotor shaft core 102, an inner rotor cover 103, a shaft core pull rod 104, a roller 105, a roll ball 106, a slip ring sheet 107, a nut or plug 108, and an inner rotor sensor scale mark 109.

The outer rotor 2 comprises an outer rotor blade 201, an outer rotor shaft core 202, an outer rotor cylinder 203, a combustion chamber exhaust port 204, a combustion chamber ignition or fuel injection port 205, a buffer chamber gas inlet port 206, a buffer chamber exhaust port 207 and a combustion chamber gas inlet port 208.

The numerical control motor 3 refers to various motors with a speed or a torque capable of being regulated according to an instruction.

The rotating speed sensor 6 comprises a sensor probe that directly reads a rotating speed, and also comprises a rotating speed feedback that is indirectly read from the numerical control motor 3, or a rotating speed feedback of other parts mechanically linked with the power output shaft 9.

On the combination and structural connection of various parts, the inner rotor 1 comprises the inner rotor shaft core 102 and the inner rotor blade 101, the outer rotor 2 comprises the outer rotor cylinder 203 and the outer rotor blade 201, the inner rotor shaft core 102 is freely and rotatably connected to the outer rotor cylinder 203 coaxially to form an annular cavity, the inner rotor blade 101 and the outer rotor blade 201 divide the cavity into a combustion chamber 18 and a buffer chamber 19, and the outer rotor cylinder corresponding to the combustion chamber 18 is provided with the combustion chamber gas inlet port 208, the combustion chamber exhaust port 204, and the combustion chamber ignition port or fuel injection port 205 penetrating through the cylinder. Any end of the inner rotor 1 or the outer rotor 2 may be connected to the power output shaft 9, the other rotor is directly or indirectly connected to a rotating shaft of the numerical control motor 3, the inner rotor 1 and the outer rotor 2 rotate in the same direction with a rotating angle difference within a round angle during working of the engine, the rotating speed sensor 6 records rotating speeds of the inner rotor 1 and the outer rotor 2 and feeds the rotating speeds back to the microcomputer controller 5, the microcomputer controller 5 sends a speed regulation instruction to the numerical control motor 3 to control the rotating angle difference between the inner rotor 1 and the outer rotor 2, and controls switching on and off of control valves of the combustion chamber gas inlet port 208, the combustion chamber exhaust port 204, and the combustion chamber ignition port or fuel injection port 205 to realize circulation of four strokes of suction, compression, expansion work and exhaust, and the storage battery 4 provides a power supply for the microcomputer controller 5 and the numerical control motor 3.

In order to further optimize the above technical solution, the numerical control motor 3 is connected to the inertia flywheel 10 first, and then connected to the outer rotor 2 from the inertia flywheel 10 through the power input shaft 8.

In order to further optimize the above technical solution, the outer rotor cylinder 203 corresponding to the buffer chamber 19 is provided with the buffer chamber gas inlet port 206 and the buffer chamber exhaust port 207 which penetrate through the cylinder, and the buffer chamber gas inlet port 206 and the buffer chamber exhaust port 207 are connected to a filtering and cooling box through pipelines to form internal circulation.

In order to further optimize the above technical solution, grooves are arranged at corresponding positions of the combustion chamber gas inlet port 208, the combustion chamber exhaust port 204, the combustion chamber ignition port or fuel injection port 205, the buffer chamber gas inlet port 206 and the buffer chamber exhaust port 207 on the outer rotor cylinder 203 respectively, and the combustion chamber gas inlet ring sleeve 12, the combustion chamber exhaust ring sleeve 13, the combustion chamber ignition or fuel injection ring sleeve 14, the buffer chamber gas inlet ring sleeve 15 and the buffer chamber exhaust ring sleeve 16 are freely and rotatably mounted at corresponding positions on the grooves respectively.

In order to further optimize the above technical solution, the combustion chamber gas inlet ring sleeve 12, the combustion chamber exhaust ring sleeve 13, the combustion chamber ignition or fuel injection ring sleeve 14, the buffer chamber gas inlet ring sleeve 15 and the buffer chamber exhaust ring sleeve 16 are fixedly connected with a combustion chamber gas inlet control valve 1201, a combustion chamber exhaust control valve 1301, a combustion chamber ignition or fuel injection control valve 1401, a buffer chamber gas inlet control valve 1501 and a buffer chamber exhaust control valve 1601 respectively, and switching on and off of the control valves are controlled by an instruction of the microcomputer controller 5.

In order to further optimize the above technical solution, a center shaft of the outer rotor 2 is provided with the outer rotor shaft core 202 with the same outer diameter as the inner rotor shaft core 102, two wear-resistant sealing ring pads 17 are arranged between the inner rotor shaft core 102 and the outer rotor shaft core 202, and a sum of a length of the inner rotor shaft core 102, a length of the outer rotor shaft core 202 and thicknesses of the two wear-resistant sealing ring pads 17 is equal to an in-cylinder depth of the outer rotor cylinder. In an ultimate state, the length of the inner rotor shaft core 102 may tend to be zero.

In order to further optimize the above technical solution, a through-hole pipeline is arranged in the middle of an outer rotor shaft core 202, the shaft core pull rod 104 of the inner rotor shaft core 102 penetrates through two wear-resistant sealing ring pads 17 first and then penetrates through the through-hole pipeline, and the slip ring sheet 107 locks a tail end of the shaft core pull rod 104 to tighten the outer rotor 2 and the inner rotor 1.

In order to further optimize the above technical solution, the outer rotor cylinder 203 is freely and rotatably fixed on the engine frame 7 through a frame outer rotor bearing 701, which means that the outer rotor cylinder may rotate freely but may not slide.

In order to further optimize the above technical solution, the limiting ring 11 is fixedly mounted at an outer intersection of the outer rotor 2 and the inner rotor 1, a side of the limiting ring 11 close to the inner rotor cover 103 is provided with a limiting bump, a part of the inner rotor cover 103 of the inner rotor 1 close to the limiting ring 11 is also provided with a limiting bump, and outer peripheral surfaces of the limiting ring 11 and the adjacent inner rotor cover 103 are provided with an outer rotor sensor scale mark 1101 and the inner rotor sensor scale mark 109.

Figure 15:
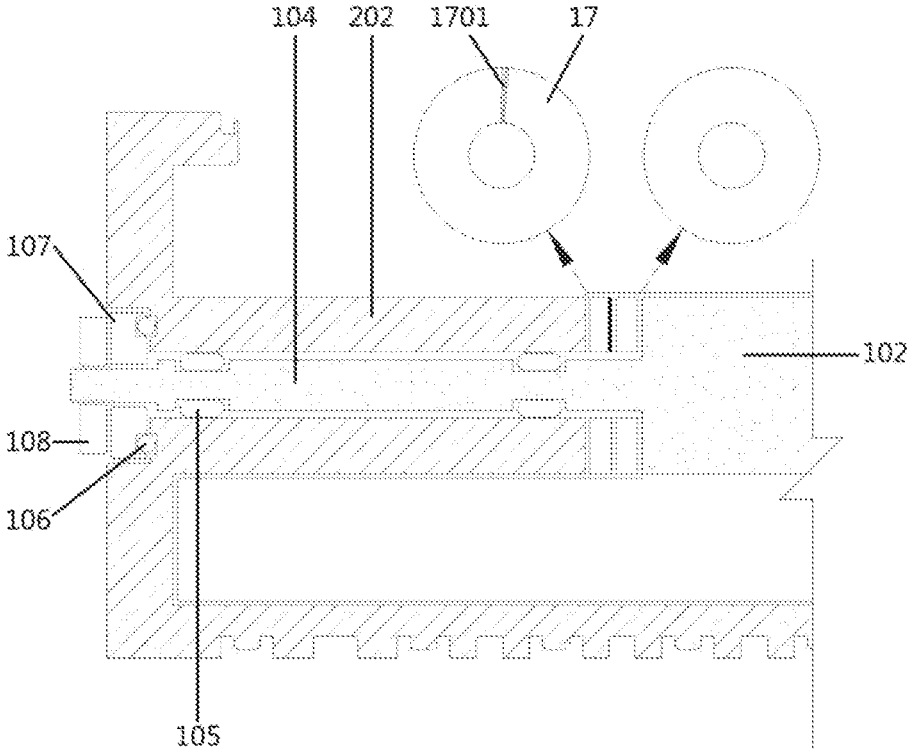
FIG. 15 is a diagram of a middle connecting node of inner and outer rotors of the present invention.
Figure 16:
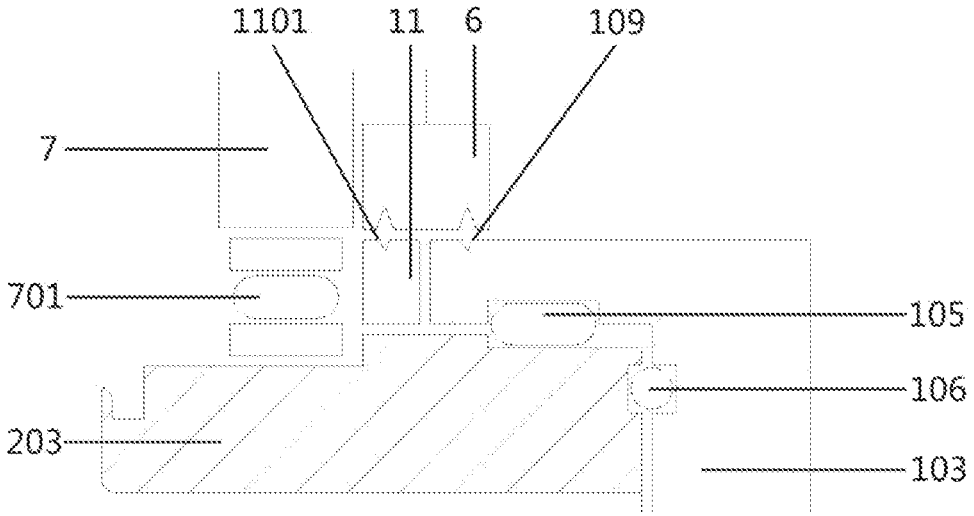
FIG. 16 is a diagram of an outer connecting node of inner and outer rotors of the present invention.
Figure 17:
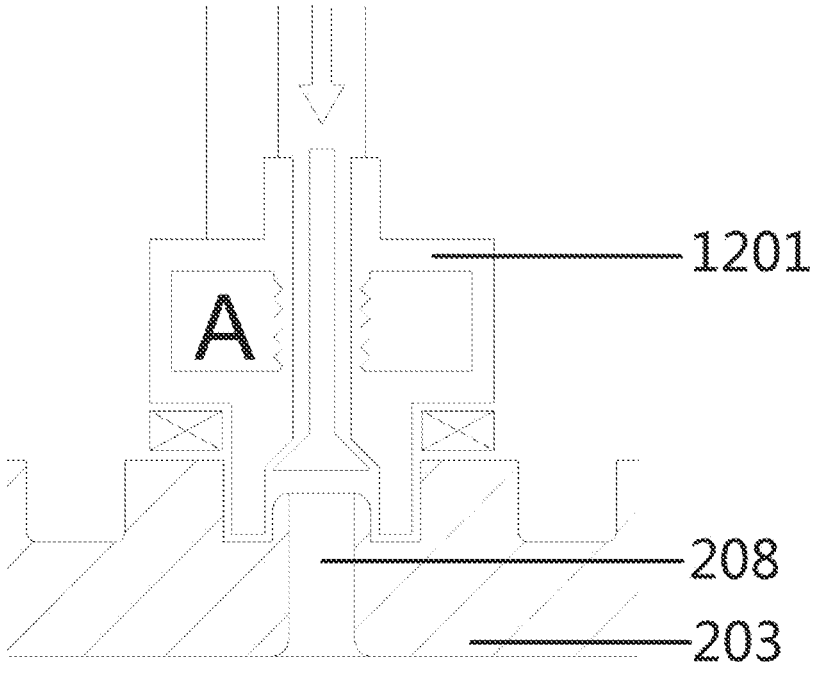
FIG. 17 is a detail drawing of a gas inlet port of the present invention.

As shown in FIG. 15 and FIG. 16, in order to further optimize the above technical solution, the outer rotor 2 and the inner rotor 1 rotate mutually in a round angle during motion, and it is necessary to ensure that the mutual rotation is smooth and sealed. The roll ball 106 or a frustum-shaped rolling shaft is added to a radially tensioned part of the outer rotor 2 and the inner rotor 1, the ball 106 is interlocked with the outer rotor cylinder 203 through the inner rotor cover 103 or interlocked with the outer rotor cylinder 203 through the slip ring sheet 107, and the roller 105 is added to an inner and outer nested rotating part of the outer rotor 2 and the inner rotor 1. The wear-resistant sealing ring pad 17 is provided with an oil guide groove 1701 on a part of the buffer chamber 19 close to the outer rotor blade 201, so as to realize lubrication circulation of engine oil from the buffer chamber 19 to the outside of the cylinder through the through hole pipeline in the middle of the outer rotor shaft core 202.

In order to further optimize the above technical solution, to ensure smooth and sealed rotation of the outer rotor 2 and the inner rotor 1, tiny gaps are reserved between the inner rotor blade 101, and an inner wall of the outer rotor cylinder 203 and an outer wall of the outer rotor shaft core 202 structurally, and sealed with elastic sealing strips, and tiny gaps are reserved between the outer rotor blade 201, and an outer wall of the inner rotor shaft core 102 and an inner wall of the inner rotor cover 103 structurally, and sealed with elastic sealing strips. Due to limited rotation effects of the wear-resistant sealing ring pad 17, the roller 105 and the roll ball 106, a space between the sealing strips may be ensured to be stable and wear-resistant.

Figure 2:
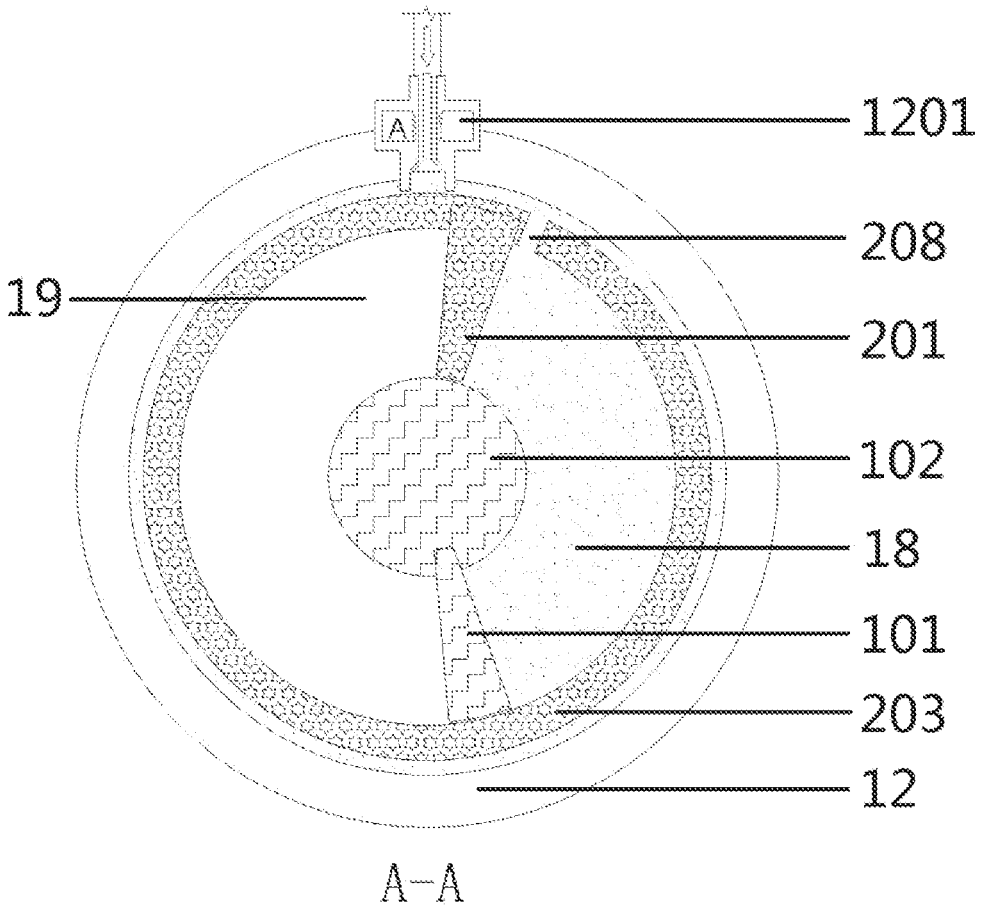
FIG. 2 is an A-A section view of the present invention.

As shown in a section view of the combustion chamber gas inlet port in FIG. 2, one groove is arranged at the combustion chamber gas inlet port 208 on the outer rotor cylinder 203, the combustion chamber gas inlet ring sleeve 12 has a "C"-shaped structure, and the ring sleeve and the groove form a rotatable but sealed annular pipeline. The combustion chamber 18 and the annular pipeline are kept in communication through the combustion chamber gas inlet port 208 in any rotating state, and gas inlet of the combustion chamber 18 is controlled by the combustion chamber gas inlet control valve 1201 at a fixed point.

Figure 3:
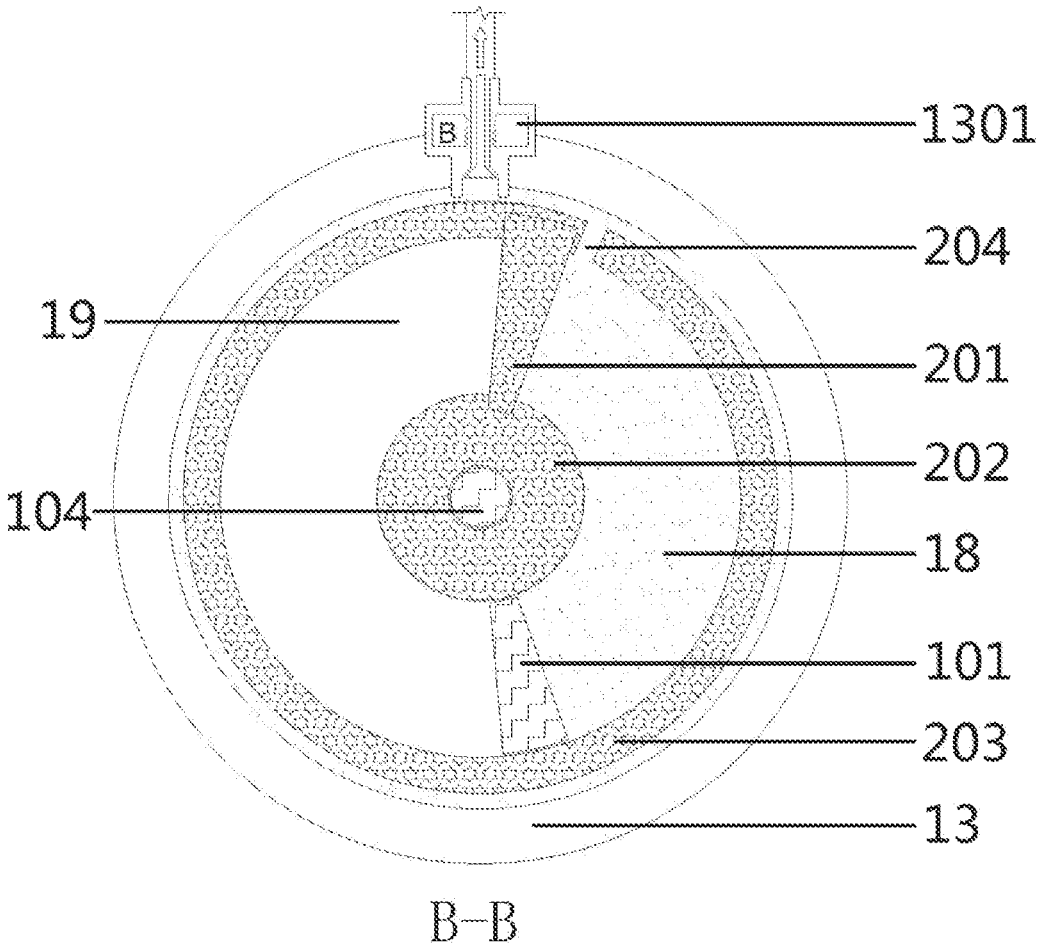
FIG. 3 is a B-B section view of the present invention.

As shown in a section view of the combustion chamber exhaust port in FIG. 3, one groove is arranged at the combustion chamber exhaust port 204 on the outer rotor cylinder 203, the combustion chamber exhaust ring sleeve 13 has a "C"-shaped structure, and the ring sleeve and the groove form a rotatable but sealed annular pipeline. The combustion chamber 18 and the annular pipeline are kept in communication through the combustion chamber exhaust port 204 in any rotating state, and gas exhaust of the combustion chamber 18 is controlled by the combustion chamber exhaust control valve 1301 at a fixed point.

Figure 4:
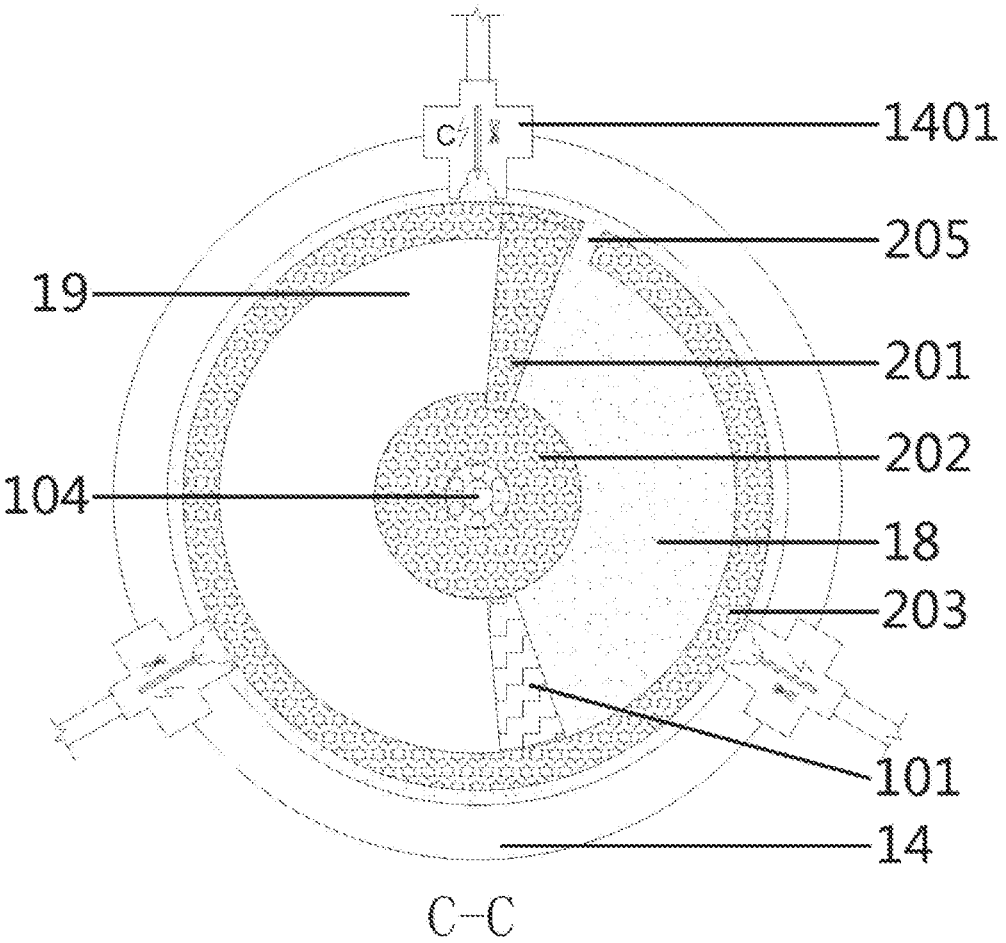
FIG. 4 is a C-C section view of the present invention.

As shown in a section view of the combustion chamber ignition or fuel injection port in FIG. 4, one groove is arranged at the combustion chamber ignition or fuel injection port 205 on the outer rotor cylinder 203, the combustion chamber ignition or fuel injection ring sleeve 14 has a "C"-shaped structure, and the ring sleeve and the groove form a rotatable but sealed annular pipeline. The combustion chamber 18 and the annular pipeline are kept in communication through the combustion chamber ignition or fuel injection port 205 in any rotating state, and one or more combustion chamber ignition or fuel injection control valves 1401 are provided. After ignition conditions are met, the combustion chamber ignition or fuel injection port 205 rotates to any nearby ignition or fuel injection control valve 1401, and the control valve is switched on to realize deflagration.

Figure 5:
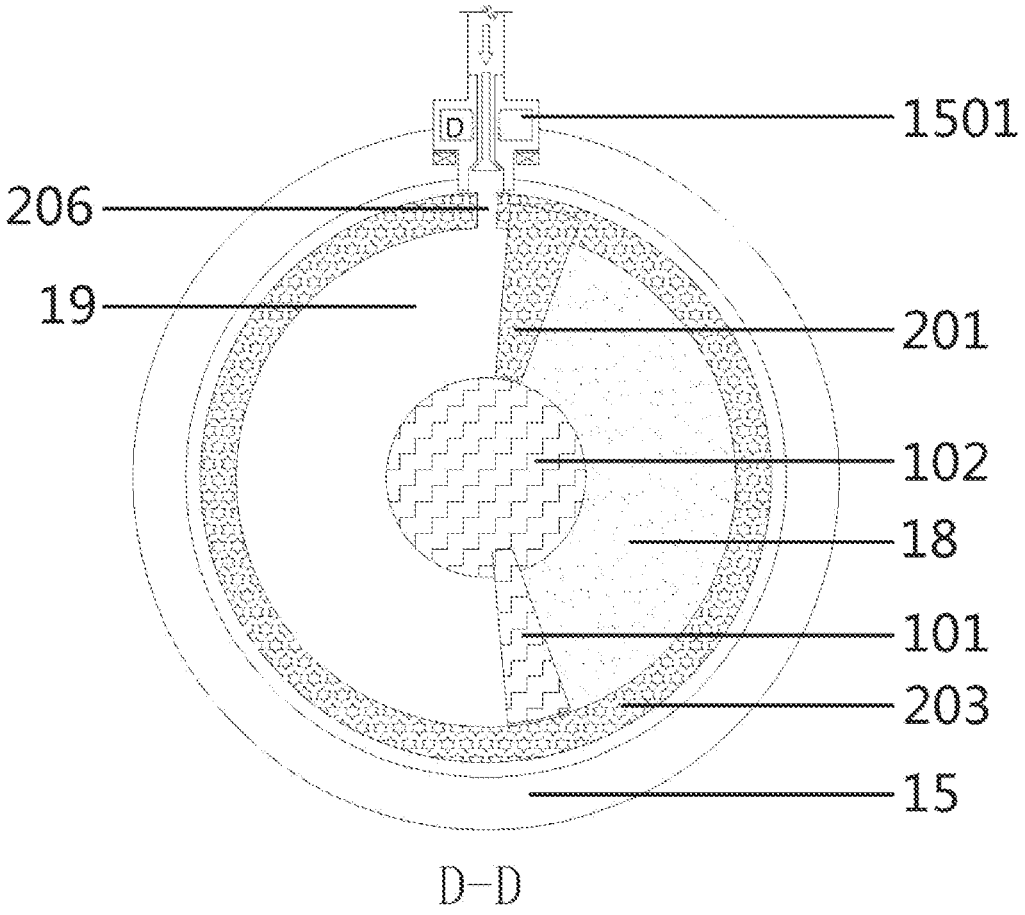
FIG. 5 is a D-D section view of the present invention.

As shown in a section view of the buffer chamber gas inlet port in FIG. 5, one groove is arranged at the buffer chamber gas inlet port 206 on the outer rotor cylinder 203, the buffer chamber gas inlet ring sleeve 15 has a "C"-shaped structure, and the ring sleeve and the groove form a rotatable but sealed annular pipeline. The buffer chamber 19 and the annular pipeline are kept in communication through the buffer chamber gas inlet port 206 in any rotating state, gas inlet of the buffer chamber 19 is controlled by the buffer chamber gas inlet control valve 1501 at a fixed point, and gas entering the buffer chamber 19 is preferably gas with atomized engine oil.

Figure 6:
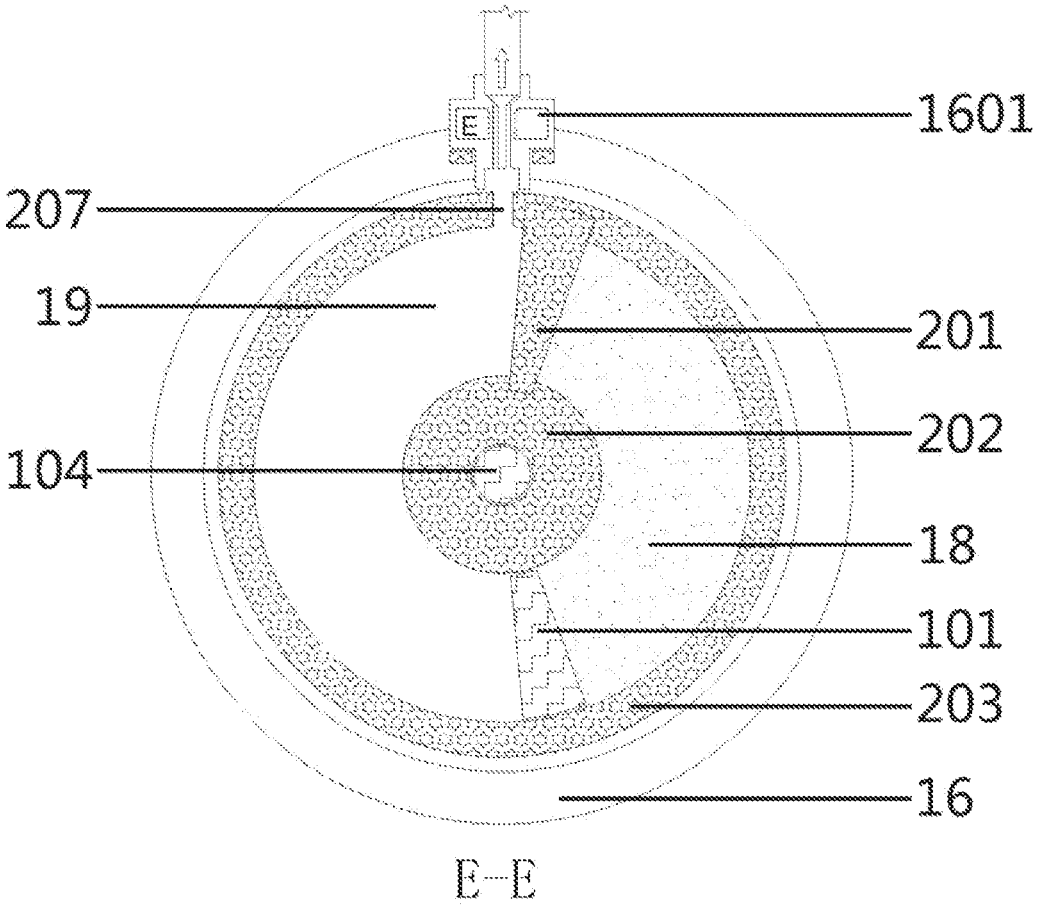
FIG. 6 is an E-E section view of the present invention.

As shown in a section view of the buffer chamber exhaust port in FIG. 6, one groove is arranged at the buffer chamber exhaust port 207 on the outer rotor cylinder 203, the buffer chamber exhaust ring sleeve 16 has a "C"-shaped structure, and the ring sleeve and the groove form a rotatable but sealed annular pipeline. The buffer chamber 19 and the annular pipeline are kept in communication through the buffer chamber exhaust port 207 in any rotating state, and gas exhaust of the buffer chamber 19 is controlled by the buffer chamber exhaust control valve 1601 at a fixed point.

Further, a working process principle of the rotary oil-electricity hybrid engine is described with reference to the drawings in the specification.

Figure 7:
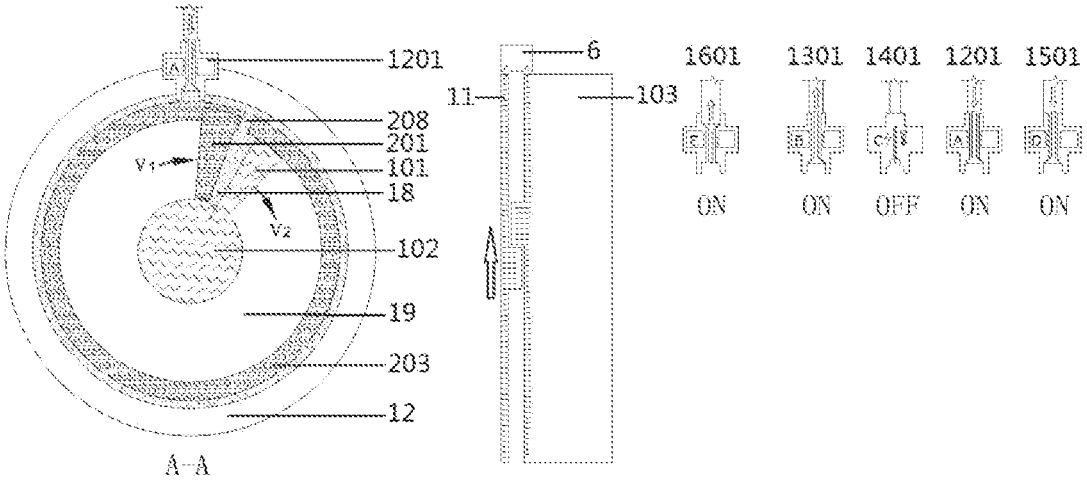
FIG. 7 is a state diagram of cold start of the present invention.

As shown in a state diagram of the cold start of the present invention in FIG. 7, when the engine is started, the combustion chamber gas inlet control valve 1201 is switched on, the combustion chamber exhaust control valve 1301 is switched on, the combustion chamber ignition or fuel injection control valve 1401 is switched off, the buffer chamber gas inlet control valve 1501 is switched on, and the buffer chamber exhaust control valve 1601 is switched on. The combustion chamber 18 and the buffer chamber 19 are communicated with the outside, and the numerical control motor 3 rotates to drive the outer rotor 2 to rotate, and the outer rotor 2 is meshed with a bump of the inner rotor cover 103 through the limiting bump of the limiting ring 11 to drive the inner rotor 1 to rotate at the same rotating speed in an accelerated manner. At the moment, an outer rotor rotating speed V1 is equal to an inner rotor rotating speed V2, the combustion chamber 18 has the smallest volume, and the buffer chamber 19 has the largest volume.

Figure 8:
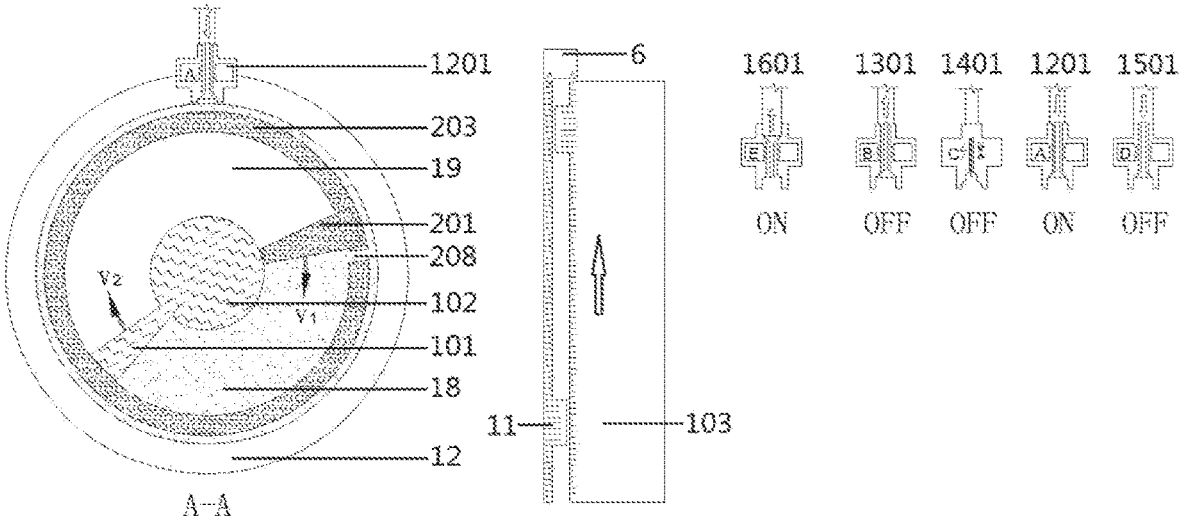
FIG. 8 is a state diagram of a suction stroke of the present invention.

As shown in a state diagram of the suction stroke of the present invention in FIG. 8, after the inner and outer rotors reach a common high rotating speed, the numerical control motor 3 is decelerated to drive the outer rotor blade 201 to be decelerated, and the inner rotor blade 101 is accelerated to be opened relative to the outer rotor 201 under inertia, so that the combustion chamber gas inlet control valve 1201 is switched on, the combustion chamber exhaust control valve 1301 is switched off, the combustion chamber ignition or fuel injection control valve 1401 is switched off, the buffer chamber gas inlet control valve 1501 is switched off, and the buffer chamber exhaust control valve 1601 is switched on. At the moment, the outer rotor rotating speed V1 is lower than the inner rotor rotating speed V2, and the volume of the combustion chamber 18 is increased to suck in mixed oil and gas or air, thus completing the suction stroke.

Figure 9:
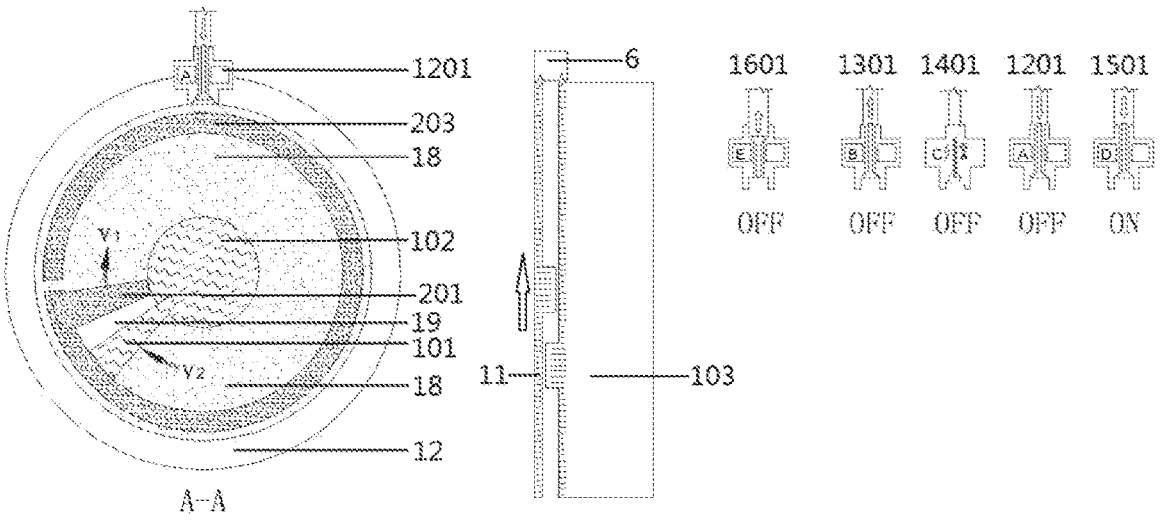
FIG. 9 is a state diagram of a compression stroke of the present invention.

As shown in a state diagram of the compression stroke of the present invention in FIG. 9, the rotating speed sensor 6 records a speed difference between the inner and outer rotors, and feeds the speed difference back to the microcomputer controller 5 for data analysis and treatment to obtain a relative angle difference between the inner and outer rotors. After the suction stroke is completed to enter the compression stroke, and the numerical control motor 3 is accelerated to drive the outer rotating blade 201 to be closed towards the inner rotor blade 101 in an accelerated manner, so that the combustion chamber gas inlet control valve 1201 is switched off, the combustion chamber exhaust control valve 1301 is switched off, the combustion chamber ignition or fuel injection control valve 1401 is switched off, the buffer chamber gas inlet control valve 1501 is switched on, and the buffer chamber exhaust control valve 1601 is switched off. At the moment, the outer rotor rotating speed V1 is higher than the inner rotor rotating speed V2, and the volume of the combustion chamber 18 is compressed in a sealed manner, thus completing the compression stroke.

Figure 10:
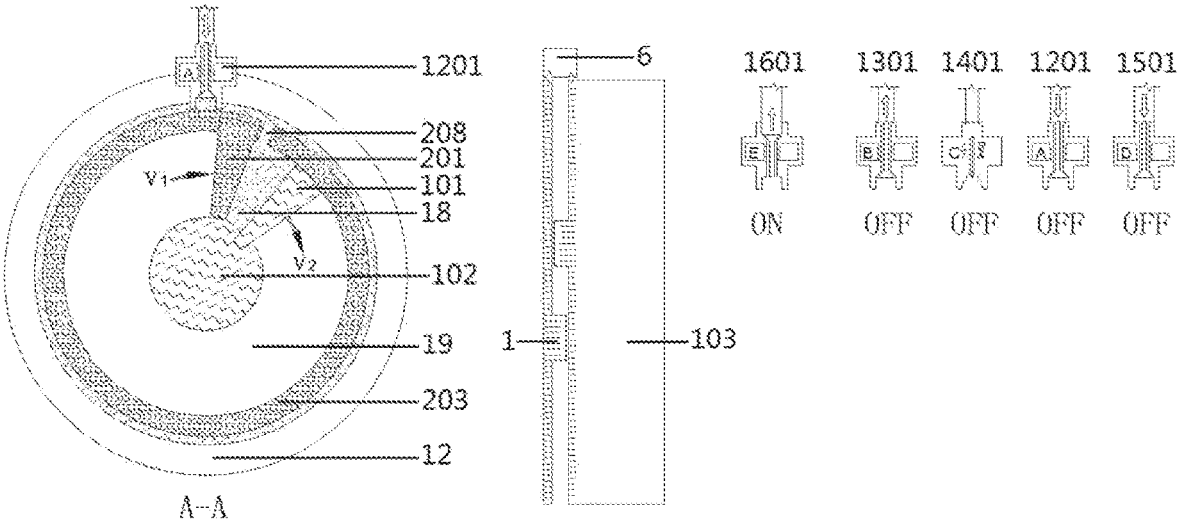
FIG. 10 is a state diagram after compression and before ignition of the present invention.

As shown in a state diagram after compression and before ignition of the present invention in FIG. 10, when the compression stroke is completed, the outer rotor rotating speed V1 is equal to the inner rotor rotating speed V2, and an air pressure in the combustion chamber is greater than an atmospheric pressure. At the moment, the combustion chamber is equivalent to a compressed spring chamber, and the microcomputer controller 5 may choose ignition or fuel injection timing to carry out frequency conversion combustion treatment according to actual situations, which means that ignition is not carried out temporarily in the case of reduced load or idle empty load, so that the numerical control motor 3 directly drives the power output shaft 9 to rotate through compressed gas in the combustion chamber 18.

Figure 11:
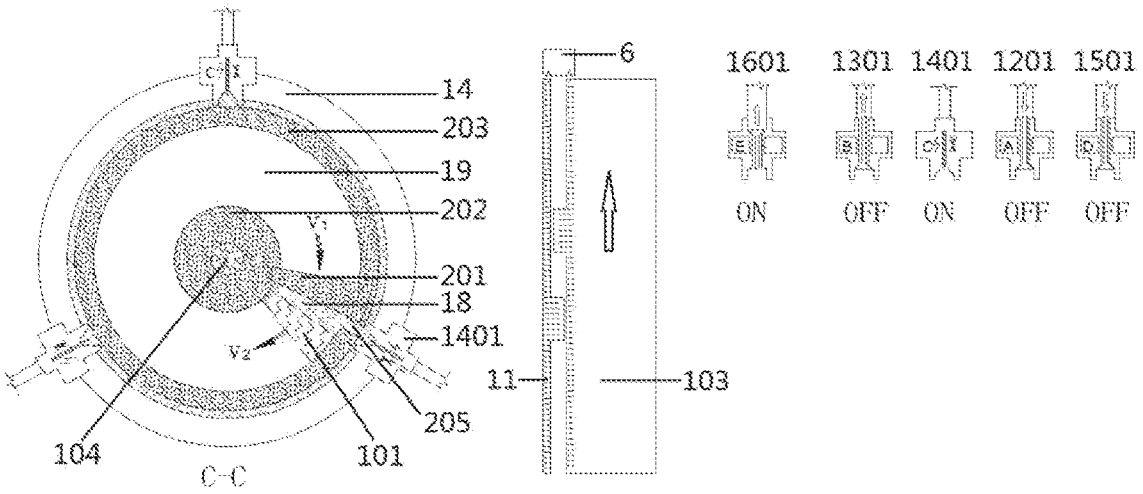
FIG. 11 is a state diagram during ignition or fuel injection of the present invention.

As shown in a state diagram during ignition or fuel injection of the present invention in FIG. 11, after the compression stroke is completed, the inner and outer rotors rotate at the same rotating speed, and when the combustion chamber ignition or fuel injection port 205 passes through the nearby combustion chamber ignition or fuel injection control valve 1401, the microcomputer controller 5 sends a switching on instruction to the combustion chamber ignition or fuel injection control valve 1401 to cause expansion work. According to momentum conservation $(M1+M2)\times V0=M1V1+M2V2$, an outer rotor system with a mass of M1 and an inner rotor system with a mass of M2 rotate in the same direction at the same rotating speed V0 before deflagration, the outer rotor system may comprise the inertia flywheel 10 and the numerical control motor 3, and M1 is much larger than M2, so that the outer rotor 2 pushes the inner rotor 1 to rotate in an accelerated manner to do external work after deflagration at a rotating speed slightly lower than that before deflagration.

Figure 12:
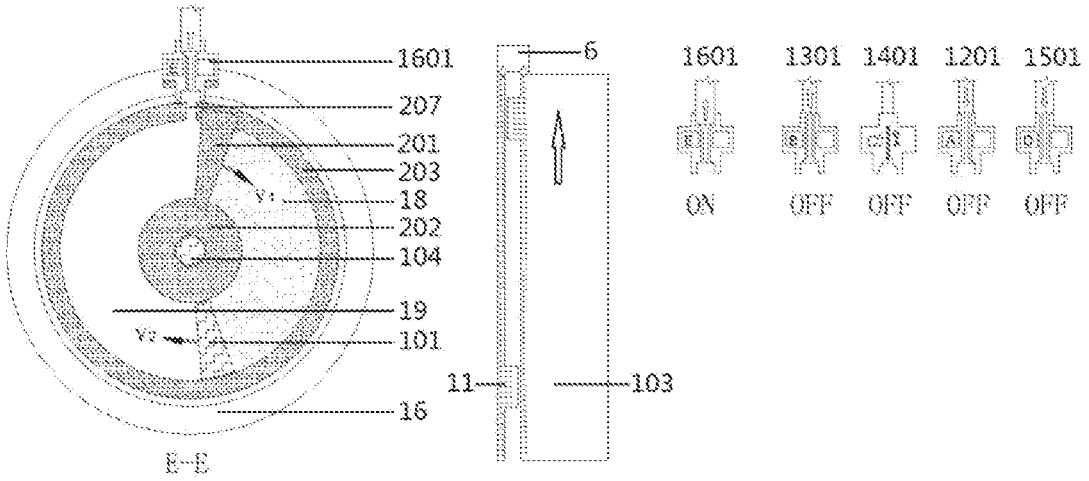
FIG. 12 is a state diagram of a work stroke of the present invention.

As shown in a state diagram of the work stroke of the present invention in FIG. 12, after deflagration, the combustion chamber gas inlet control valve 1201 is switched off, the combustion chamber exhaust control valve 1301 is switched off, the combustion chamber ignition or fuel injection control valve 1401 is switched off, the buffer chamber gas inlet control valve 1501 is switched off, and the buffer chamber exhaust control valve 1601 is switched on. The combustion chamber 18 is expanded, the inner rotor blade 101 is opened relative to the outer rotor blade 201, and the air pressure in the combustion chamber 18 is gradually decreased. At the moment, the outer rotor rotating speed V1 is lower than the inner rotor rotating speed V2, thus completing the expansion work stroke.

Figure 13:
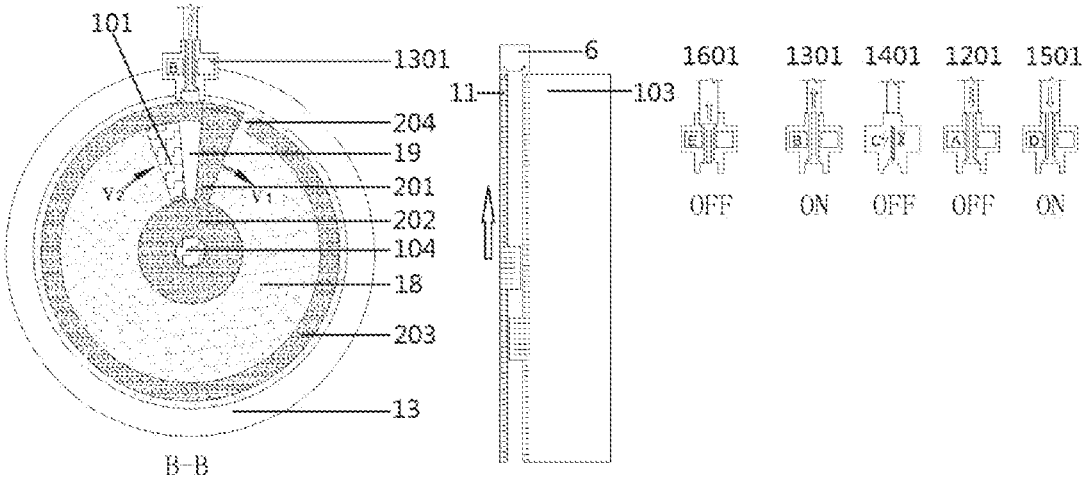
FIG. 13 is a state diagram of an exhaust stroke of the present invention.

As shown in a state diagram of the exhaust stroke of the present invention in FIG. 13, at a tail end of the expansion work stroke, the microcomputer controller 5 analyzes the angle difference between the inner and outer rotors according to data fed back by the rotating speed sensor 6, and sends an acceleration instruction to the numerical control motor 3 before the inner rotor 1 reaches the maximum angle difference, so that the outer rotor rotating speed V1 is higher than the inner rotor rotating speed V2, the combustion chamber gas inlet control valve 1201 is switched off, the combustion chamber exhaust control valve 1301 is switched on, the combustion chamber ignition or fuel injection control valve 1401 is switched off, the buffer chamber gas inlet control valve 1501 is switched on, and the buffer chamber exhaust control valve 1601 is switched off. The outer rotating blade 201 catches up relative to the inner rotor blade 101, and the volume of the combustion chamber 18 becomes smaller to exhaust waste gas, thus completing the exhaust stroke. When the engine needs to be decelerated, the microcomputer controller 5 may carry out analysis and frequency conversion treatment according to data fed back by the rotating speed sensor 6, and may switch off the buffer chamber exhaust control valve 1601 in advance to make the sealed buffer chamber 19 form a joint action of a gas recoil pad and the limiting bump of the limiting ring 11, thus decelerating the inner rotor 1 through the outer rotor 2.

Figure 14:
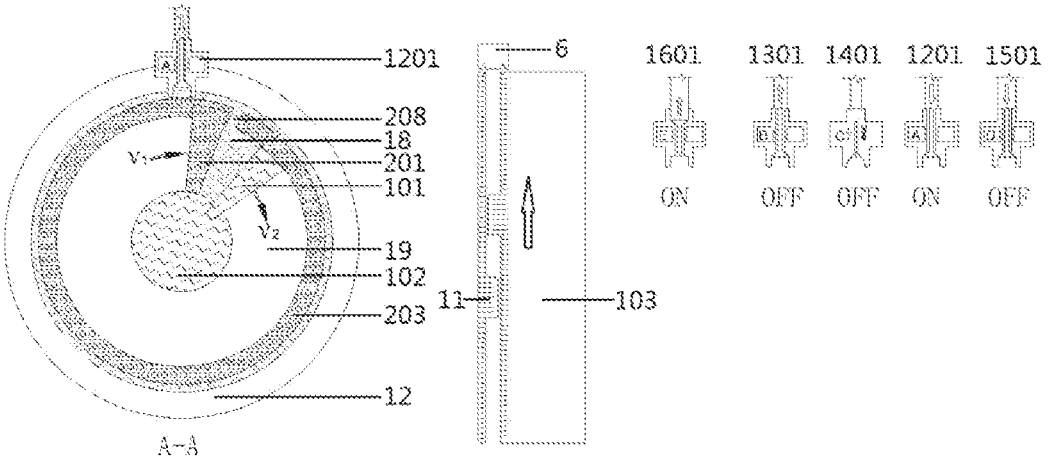
FIG. 14 is a state diagram of second circulation entered after exhaust of the present invention.

As shown in a state diagram of second circulation entered after exhaust of the present invention in FIG. 14, when the normal four-stroke circulation is entered, a difference between the suction state and the suction of the cold start is that a reserved space during the suction is larger than that during the cold start, so as to ensure that a component under the circulation has compressed gas as a buffer zone, thus protecting the engine.

Figure 18:
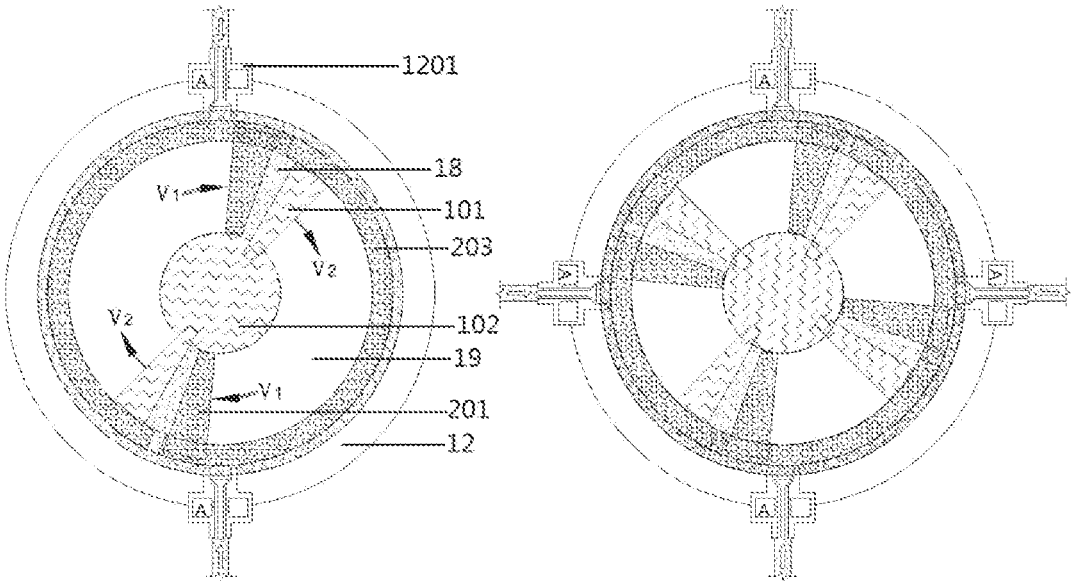
FIG. 18 is a multi-cylinder pattern diagram of the present invention.

As shown in a multi-cylinder pattern diagram of the present invention in FIG. 18, the solution of the present invention is illustrated by the most basic mode of single cylinder and single piston, and the outer rotator blade 201 and the inner rotor blade 101 may be added in pairs to form a multi-cylinder engine with four chambers, six chambers, eight chambers and the like.

The rotary oil-electricity hybrid engine is realized by controlling a volume change of a combustion chamber of an internal combustion engine with the rotating speed of the numerical control motor, the piston only needs to rotate in the same direction all the time to do external work, and the inertia of the inner and outer rotors always moves along a direction of doing work to make full use of mechanical energy stored by the inertia.

According to the rotary oil-electricity hybrid engine, the compression ratio may be subjected to frequency conversion regulation at any time, and combustion in any state does positive work to the outside, so that the engine knocking problem that may occur in traditional engines is overcome, and the rotary oil-electricity hybrid engine can adapt to an ignition fuel and a compression ignition fuel with wide adaptability.

The foregoing descriptions of the disclosed embodiments enable those skilled in the art to realize or use the present invention. Many modifications to these embodiments will be apparent to those skilled in the art, and general principles defined herein may be implemented in other embodiments without departing from the spirit or scope of the present invention. Therefore, the present invention should not be limited to the embodiments shown herein, but should comply with the widest scope consistent with the principles and novel features disclosed herein.

The invention claimed is:

1. A rotary oil-electricity hybrid engine, comprising an inner rotor, an outer rotor, a numerical control motor, a storage battery, a microcomputer controller, a rotating speed sensor and a power output shaft, wherein, the inner rotor comprises an inner rotor shaft core and an inner rotor blade, the outer rotor comprises an outer rotor cylinder and an outer rotor blade, the inner rotor shaft core is freely and rotatably connected to the outer rotor cylinder coaxially to form an annular cavity, the inner rotor blade and the outer rotor blade divide the cavity into a combustion chamber and a buffer chamber, and the outer rotor cylinder corresponding to the combustion chamber is provided with a gas inlet port, an exhaust port, and an ignition port or fuel injection port penetrating through the cylinder; and the inner rotor or the outer rotor is connected to the power output shaft, the other rotor is directly or indirectly connected to a rotating shaft of the numerical control motor, the inner rotor and the outer rotor rotate in the same direction with a rotating angle difference within a round angle during working of the engine, the rotating speed sensor records rotating speeds of the inner rotor and the outer rotor and feeds the rotating speeds back to the microcomputer controller, the microcomputer controller sends a speed regulation instruction to the numerical control motor to control the rotating angle difference between the inner rotor and the outer rotor, and controls switching on and off of control valves of the combustion chamber gas inlet port, the combustion chamber exhaust port, and the combustion chamber ignition port or fuel injection port to realize circulation of four strokes of suction, compression, expansion work and exhaust, and the storage battery provides a power supply for the microcomputer controller and the numerical control motor.

2. The rotary oil-electricity hybrid engine according to claim 1, wherein the numerical control motor is connected to an inertia flywheel first, and then connected to the outer rotor from the inertia flywheel through a power input shaft.

3. The rotary oil-electricity hybrid engine according to claim 1, wherein the outer rotor cylinder corresponding to the buffer chamber is provided with a buffer chamber gas inlet port and a buffer chamber exhaust port which penetrate through the cylinder, and the buffer chamber gas inlet port and the buffer chamber exhaust port are connected to a filtering and cooling box through pipelines to form internal circulation.

4. The rotary oil-electricity hybrid engine according to claim 1, wherein grooves are arranged at corresponding positions of the combustion chamber gas inlet port, the combustion chamber exhaust port, the combustion chamber ignition port or fuel injection port, a buffer chamber gas inlet port and a buffer chamber exhaust port on the outer rotor cylinder respectively, and a combustion chamber gas inlet ring sleeve, a combustion chamber exhaust ring sleeve, a combustion chamber ignition or fuel injection ring sleeve, a buffer chamber gas inlet ring sleeve and a buffer chamber exhaust ring sleeve are freely and rotatably mounted at corresponding positions on the grooves respectively.

5. The rotary oil-electricity hybrid engine according to claim 1, wherein a combustion chamber gas inlet ring sleeve, a combustion chamber exhaust ring sleeve, a combustion chamber ignition or fuel injection ring sleeve, a buffer chamber gas inlet ring sleeve and a buffer chamber exhaust ring sleeve are fixedly connected with a combustion chamber gas inlet control valve, a combustion chamber exhaust control valve, a combustion chamber ignition or fuel injection control valve, a buffer chamber gas inlet control valve and a buffer chamber exhaust control valve respectively, and switching on and off of the control valves are controlled by an instruction of the microcomputer controller.

6. The rotary oil-electricity hybrid engine according to claim 1, wherein a center shaft of the outer rotor is provided with an outer rotor shaft core with the same outer diameter as the inner rotor shaft core, two wear-resistant sealing ring pads are arranged between the inner rotor shaft core and the outer rotor shaft core, and a sum of a length of the inner rotor shaft core, a length of the outer rotor shaft core and thicknesses of the two wear-resistant sealing ring pads is equal to an in-cylinder depth of the outer rotor cylinder.

7. The rotary oil-electricity hybrid engine according to claim 1, wherein a through-hole pipeline is arranged in the middle of an outer rotor shaft core, a shaft core pull rod of the inner rotor shaft core penetrates through two wear-resistant sealing ring pads first and then penetrates through the through-hole pipeline, and a slip ring sheet locks a tail end of the shaft core pull rod to tighten the outer rotor and the inner rotor.

8. The rotary oil-electricity hybrid engine according to claim 1, wherein the outer rotor cylinder is freely and rotatably fixed on an engine frame through a frame outer rotor bearing.

9. The rotary oil-electricity hybrid engine according to claim 1, wherein a limiting ring is fixedly mounted at an outer intersection of the outer rotor and the inner rotor, a side of the limiting ring close to an inner rotor cover is provided with a limiting bump, a part of the inner rotor cover of the inner rotor close to the limiting ring is also provided with a limiting bump, and outer peripheral surfaces of the limiting ring and the adjacent inner rotor cover are provided with sensor scale marks.

* * * * *